US010433374B2

(12) United States Patent
Holms et al.

(10) Patent No.: US 10,433,374 B2
(45) Date of Patent: Oct. 1, 2019

(54) ELECTRIC INDUCTION MELTING ASSEMBLY

(71) Applicant: Consarc Corporation, Rancocas, NJ (US)

(72) Inventors: Gerrard Holms, Mount Laurel, NJ (US); Mark Wilmerton, Tabernacle, NJ (US); John D. Nelson, Berlin, NJ (US)

(73) Assignee: CONSARC CORPORATION, Rancocas, NJ (US)

( * ) Notice: Subject to any disclaimer, the term of this patent is extended or adjusted under 35 U.S.C. 154(b) by 299 days.

(21) Appl. No.: 15/143,597

(22) Filed: May 1, 2016

(65) Prior Publication Data

US 2016/0249415 A1 Aug. 25, 2016

Related U.S. Application Data

(62) Division of application No. 13/565,085, filed on Aug. 2, 2012, now Pat. No. 9,332,594.

(60) Provisional application No. 61/523,609, filed on Aug. 15, 2011.

(51) Int. Cl.

| | |
|---|---|
| ***H05B 6/26*** | (2006.01) |
| ***F27B 14/02*** | (2006.01) |
| ***F27B 14/04*** | (2006.01) |
| ***F27B 14/06*** | (2006.01) |
| ***F27B 14/08*** | (2006.01) |
| ***H05B 6/36*** | (2006.01) |

(52) U.S. Cl.

CPC ..... *H05B 6/26* (2013.01); *F27B 14/02* (2013.01); *F27B 14/04* (2013.01); *F27B 14/061* (2013.01); *F27B 14/08* (2013.01); *H05B 6/36* (2013.01)

(58) Field of Classification Search

CPC ..... F27B 2014/0818; F27B 14/061; F27B 14/02; F27B 14/04; H05B 11/00; H05B 6/24; H05B 6/26; H05B 6/36; F27D 17/003; C21C 7/10

USPC .... 373/4, 6, 7, 8, 9, 84, 138, 140, 141, 143, 373/149, 152, 156

See application file for complete search history.

(56) References Cited

U.S. PATENT DOCUMENTS

| | | | | | |
|---|---|---|---|---|---|
| 1,552,142 | A * | 9/1925 | Gray | F27D 11/08 | 313/147 |
| 1,818,812 | A * | 8/1931 | Musso | F27D 11/02 | 266/900 |
| 1,971,195 | A * | 8/1934 | McKibben | H05B 6/26 | 373/141 |
| 2,826,624 | A * | 3/1958 | Reese | H05B 6/28 | 373/151 |
| 3,046,320 | A * | 7/1962 | Gassen | H05B 6/26 | 373/141 |

(Continued)

*Primary Examiner* — Jimmy Chou
(74) *Attorney, Agent, or Firm* — Philip O. Post

(57) ABSTRACT

A dry-break electrical disconnect is provided between an induction melting furnace and a component of the electric induction melting assembly in which the furnace is removably installed for melting in a vacuum or otherwise controlled environmental chamber. Electric power connections are made to the induction melting furnace in a sealed interior volume of the assembly component that can be pressurized and of a different environment than that in the controlled environmental chamber. The assembly component may be a tilting cradle installed in the controlled environment chamber.

18 Claims, 8 Drawing Sheets

(56) References Cited

U.S. PATENT DOCUMENTS 3,149,959 A * 9/1964 Nicholson ..... C21C 7/10 164/258
3,226,223 A * 12/1965 Gruber ..... C22B 9/228 164/496
3,246,373 A * 4/1966 Lyman ..... B01F 13/0809 164/136
3,300,564 A * 1/1967 Junker ..... C21C 5/5241 219/628
3,300,565 A * 1/1967 Junker ..... C21C 5/5241 15/DIG. 2
3,303,258 A * 2/1967 Junker ..... C21C 5/5241 138/178
3,303,259 A * 2/1967 Junker ..... C21C 5/5241 219/628
3,450,823 A * 6/1969 Willan ..... C21C 5/52 164/337
3,737,153 A * 6/1973 Steffora ..... B22D 11/10 266/240
3,790,338 A * 2/1974 Duca ..... F27B 14/02 266/240
3,901,999 A * 8/1975 Landis ..... H05B 6/24 373/156
3,917,241 A * 11/1975 Steffora ..... B22D 11/10 266/240
3,918,692 A * 11/1975 Oberg ..... C21B 13/0013 266/218
3,999,001 A * 12/1976 Overmyer ..... F27D 3/18 373/84
4,185,157 A * 1/1980 Sjogren ..... B08B 15/02 373/143
4,227,033 A * 10/1980 Nikolov ..... F27B 14/061 373/140
4,583,230 A * 4/1986 Komada ..... H05B 6/26 373/156
4,641,319 A * 2/1987 Nagai ..... B22D 39/04 164/453
4,653,064 A * 3/1987 Hixenbaugh ..... F27B 3/085 266/144
4,658,404 A * 4/1987 Sick ..... H05B 6/26 373/143
4,695,316 A * 9/1987 Cartlidge ..... H05B 6/24 373/7
4,745,620 A * 5/1988 Mortimer ..... B22D 18/08 164/513
4,773,079 A * 9/1988 Bruckmann ..... C22B 9/003 373/141
5,054,033 A * 10/1991 Wronka ..... C21C 5/5211 266/196
5,153,894 A * 10/1992 Ehle ..... C21C 5/5211 373/100
5,268,925 A * 12/1993 Binder ..... C04B 35/653 266/226
5,271,033 A * 12/1993 Bethge ..... F27B 14/04 373/138
5,339,329 A * 8/1994 Flinchum ..... C23C 2/006 118/410
5,393,037 A * 2/1995 Ehle ..... F27B 3/085 266/144
5,416,794 A * 5/1995 Cignetti ..... B22D 41/015 373/143
5,425,048 A * 6/1995 Heine ..... B22D 41/015 266/242
5,608,838 A * 3/1997 Brookley ..... H05B 3/64 219/553
5,753,004 A * 5/1998 Hanai ..... C21C 7/10 266/208
5,781,581 A * 7/1998 Fishman ..... F27B 14/061 219/672
5,812,587 A * 9/1998 Locatelli ..... B22D 41/04 266/242
5,898,726 A * 4/1999 Matsumoto ..... C21C 5/565 373/78
6,400,749 B1 * 6/2002 Weiss ..... F27D 11/06 373/154
6,434,182 B1 * 8/2002 Kohler ..... H05B 6/22 373/153
2008/0251233 A1 * 10/2008 Mortimer ..... F27B 3/28 164/493
2010/0163550 A1 * 7/2010 Belsh ..... F27B 14/061 219/634

* cited by examiner

ELECTRIC INDUCTION MELTING ASSEMBLY

CROSS REFERENCE TO RELATED APPLICATIONS

This is a divisional application of application Ser. No. 13/565,085, filed Aug. 2, 2012, which application claims the benefit of U.S. Provisional Application No. 61/523,609 filed Aug. 15, 2011, both of which applications are hereby incorporated herein by reference in their entireties.

FIELD OF THE INVENTION

The present invention relates to electric induction melting assemblies, and in particular, to such assemblies operating in a vacuum or other controlled environment, and rapid connect or disconnect of electric power to a removable induction melting furnace used in such assemblies.

BACKGROUND OF THE INVENTION

An electric induction melting assembly can be used in a vacuum to produce high purity alloy metals. The electric induction melting assembly can comprise an induction melting furnace (sometimes referred to as a refractory crucible) that is seated in a tilting cradle located within an industrial vacuum chamber. The furnace can be tilted in the cradle about a trunnion that is rotatably supported on a bearing so that molten metal product can be poured from the furnace into a mold or other containment vessel.

The induction melting furnace requires removal from the vacuum chamber for replacement or repair of the furnace, or to exchange one furnace with another. Removal of the induction melting furnace in some conventional vacuum induction melting assemblies can be time consuming since a hot operating furnace must remain in the chamber with cooling water flowing through the induction coil for an extended period of time to cool the furnace before electric power and cooling water source connections are manually disconnected from the furnace. This conventional procedure for repair or exchange of the furnace results in a significant loss of productivity caused by the required cooling time along with the period of time normally required for manually disconnecting and reconnecting a furnace. U.S. Pat. No. 5,125,004 (to Roberts et al.) is an example of a method of achieving a rapid exchange of power and cooling connections.

One object of the present invention is to achieve the connection of electric power to a vacuum induction melting furnace within a pressurized interior space of the furnace assembly's tilting cradle, or other mating assembly component within the vacuum chamber so that the connection or disconnection of electric power can be achieved without substantial cool down of a hot in-service induction melting assembly.

BRIEF SUMMARY OF THE INVENTION

In one aspect the invention is a method of connecting or disconnecting electric power to a vacuum induction melting furnace being installed or removed from a vacuum environment where the electrical connection is made within a pressurized interior environment of a component of the furnace assembly installed in the vacuum or otherwise controlled environment.

In another aspect the present invention is a method of operation of an induction melting furnace removably installed in a cradle disposed in a controlled environment within a controlled environment chamber. The induction melting furnace has furnace coil power leads from one or more furnace induction coils supplied to positive and negative furnace electrical spades disposed in a furnace spade power port sealably attached to a pressure plate on the induction melting furnace with the positive and negative furnace electrical spades penetrating through the pressure plate. The induction melting furnace is seated on the cradle prior to establishing the controlled environment within the controlled environment chamber so that the pressure plate forms a seal over a furnace electrical spades opening in an interior cradle volume with the positive and negative furnace electrical spades penetrating into a sealed interior cradle environment in the interior cradle volume. The interior cradle volume contains a cradle spade assembly and a spade clamping assembly. The controlled environment is established within the controlled environment chamber subsequent to seating the induction melting furnace on the cradle to isolate the sealed interior cradle environment from the controlled environment. Positive and negative cradle clamping electrical spades associated with the spade clamping assembly are moved from an opened to a closed position within the sealed interior cradle environment to close an electrical circuit between the positive furnace electrical spade that protrudes through the pressure plate into the sealed interior cradle environment and the positive cradle electrical spade associated with the cradle spade assembly. The positive cradle electrical spade is connected to the positive terminal of an external power source. Moving the positive and negative cradle clamping electrical spades from the opened to the closed position also closes an electrical circuit between the negative furnace electrical spade that protrudes through the pressure plate into the sealed interior cradle environment and the negative cradle electrical spade associated with the cradle spade assembly. The negative cradle electrical spade is connected to the negative terminal of the external power source whereby electric power from the positive and negative terminals of the external power source is provided to the one or more induction coils of the induction melting furnace. For removal of the induction melting furnace from the controlled environment chamber, the positive and negative cradle clamping electrical spades are moved to the opened position within the sealed interior cradle environment and the electrically disconnected induction melting furnace can be removed from the controlled environment chamber.

The above and other aspects of the invention are set forth in the specification and the appended claims.

BRIEF DESCRIPTION OF THE DRAWINGS

The figures, in conjunction with the specification and claims, illustrate one or more non-limiting modes of practicing the invention. The invention is not limited to the illustrated layout and content of the drawings.

FIG. 1(*b*) is a perspective view of the induction melting assembly shown in FIG. 1(*a*) with the induction melting furnace separated from the tilting cradle.

FIG. 5(*b*) is a partial cross sectional view through line B-B in FIG. 5(*a*) of one example of a flexible electrical joint used with the electric induction melting assembly of the present invention to supply electric power to the induction melting furnace.

FIG. 6(*b*) and FIG. 6(*c*) illustrate in partial cross sectional view through line D-D in FIG. 6(*a*) one example of a coaxial electrical joint used with the electric induction melting assembly of the present invention to supply electric power to the induction melting furnace.

DETAILED DESCRIPTION OF THE INVENTION

Figure 1A:
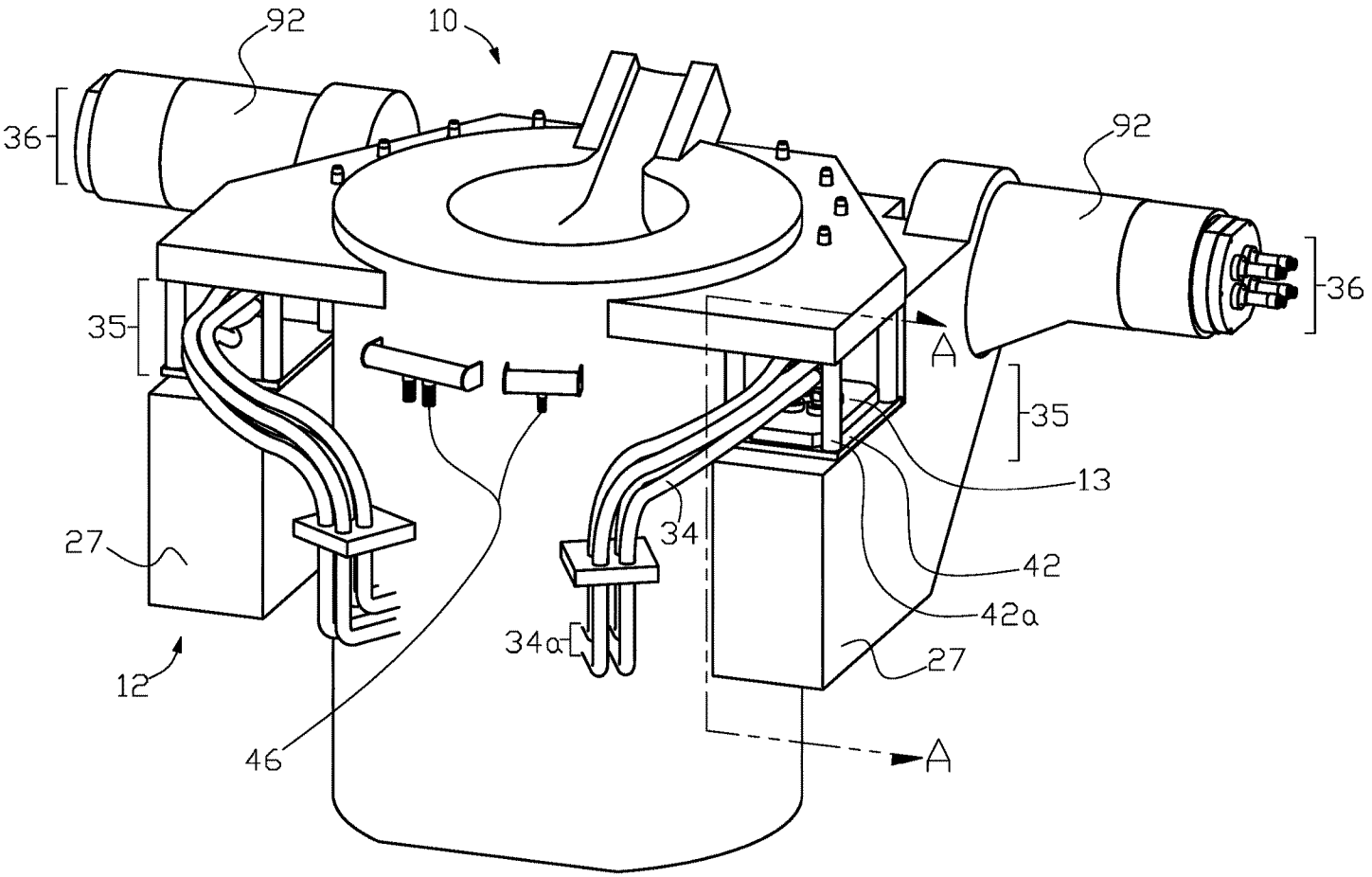
FIG. 1(*a*) is a perspective view of one example of an electric induction melting assembly of the present invention.
Figure 1B:
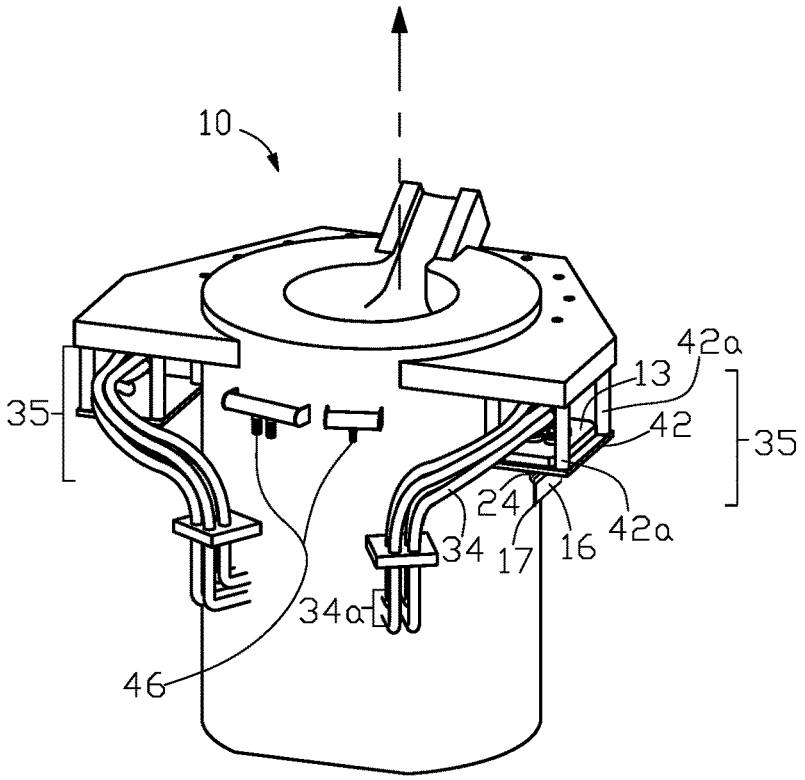
Figure 1B:
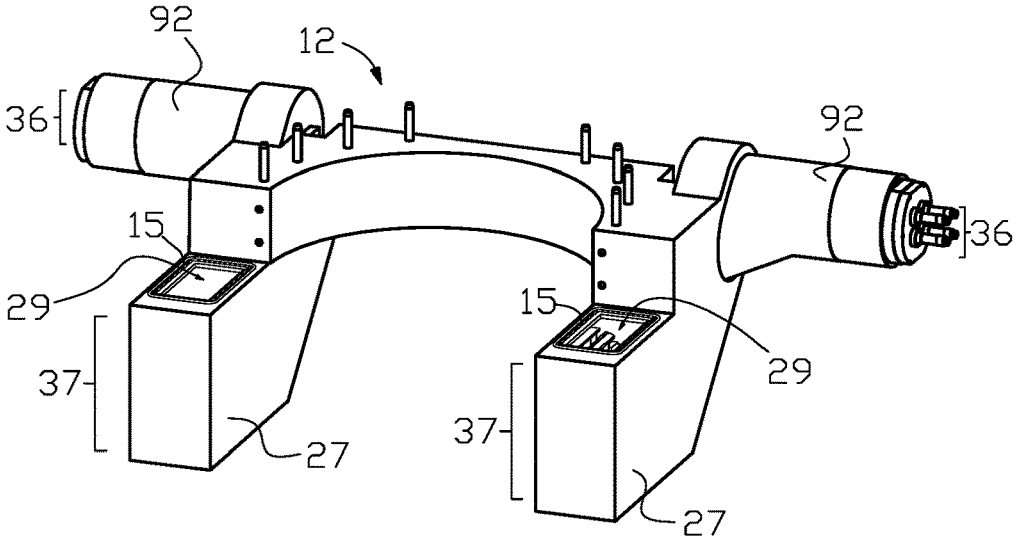
Figure 4:
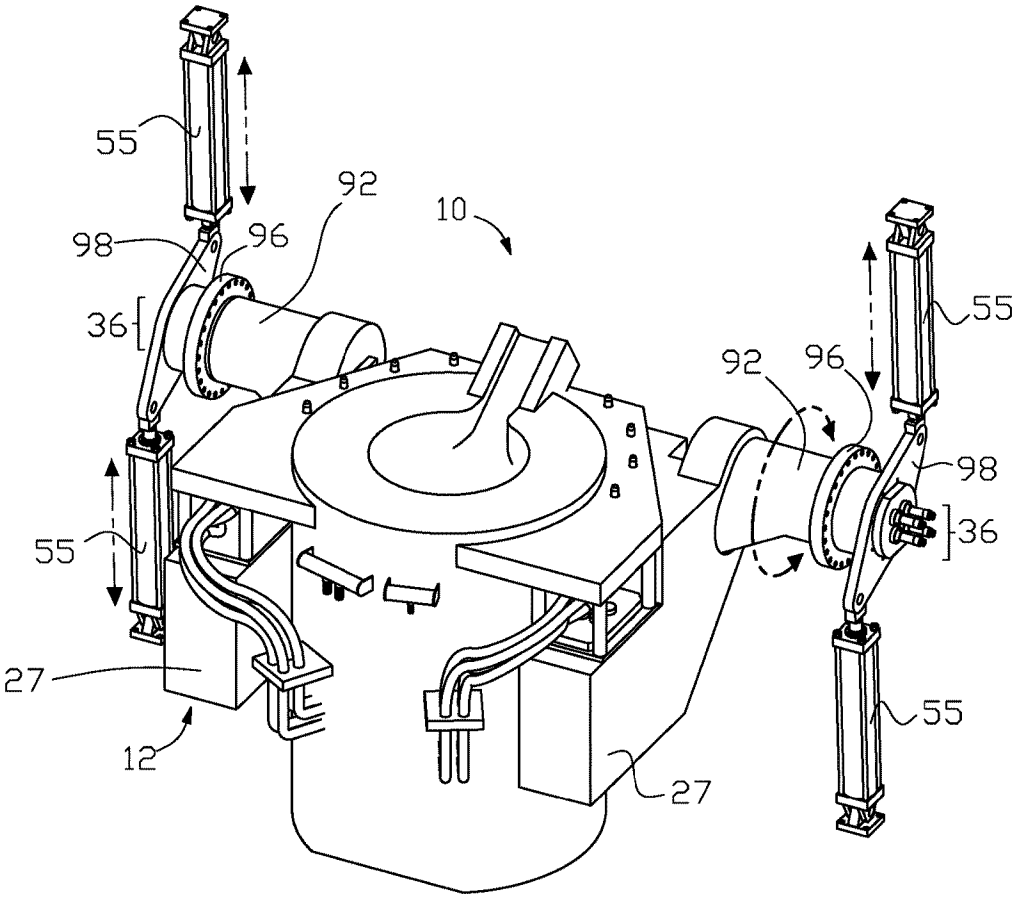
FIG. 4 is a perspective view illustrating the tilting operation of the induction melting assembly shown in FIG. 1(*a*) and FIG. 1(*b*).

There is shown in FIG. 1(*a*) through FIG. 4 one example of an electric induction melting assembly utilizing one example of the dry-break electrical disconnect of the present invention.

FIG. 1(*a*) and FIG. 1(*b*) illustrate an induction melting furnace 10 and titling cradle 12 for installation in a vacuum (or otherwise controlled) environment that form one example of an electric induction melting assembly of the present invention. In FIG. 1(*a*) furnace 10 is mated to (seated in) tilting cradle 12 as used in the vacuum environment established in an industrial vacuum chamber. In FIG. 1(*b*) furnace 10 is shown withdrawn from the cradle, for example, during a furnace removal from (or installation to) the vacuum chamber.

Components associated with the furnace 10 can include separate water-only connections 46, furnace induction coil (s) power leads 34, and furnace spade assemblies 35 as further described below. The illustrated separate water-only connections 46 and separate power leads 34 are used in an arrangement and method of connecting a water supply and coil power leads to the furnace for a dry-break electrical disconnect where the water and electric power are not supplied with common componentry.

Components associated with the tilting cradle 12 can include one or more cradle electric power ports 36 and spade clamping and cradle spade assemblies 37 (located interior to the cradle) as further described below. During a furnace removal process, each spade clamping assembly is unclamped (opened position) and the water-only connections are disconnected. The furnace is then unfastened from the tilting cradle and removed vertically (illustrated by arrow in FIG. 1(*b*)) with suitable lifting apparatus such as an overhead crane without the necessity of cool down as mentioned in the background of the invention. This removal process can be reversed for an installation.

Figure 2:
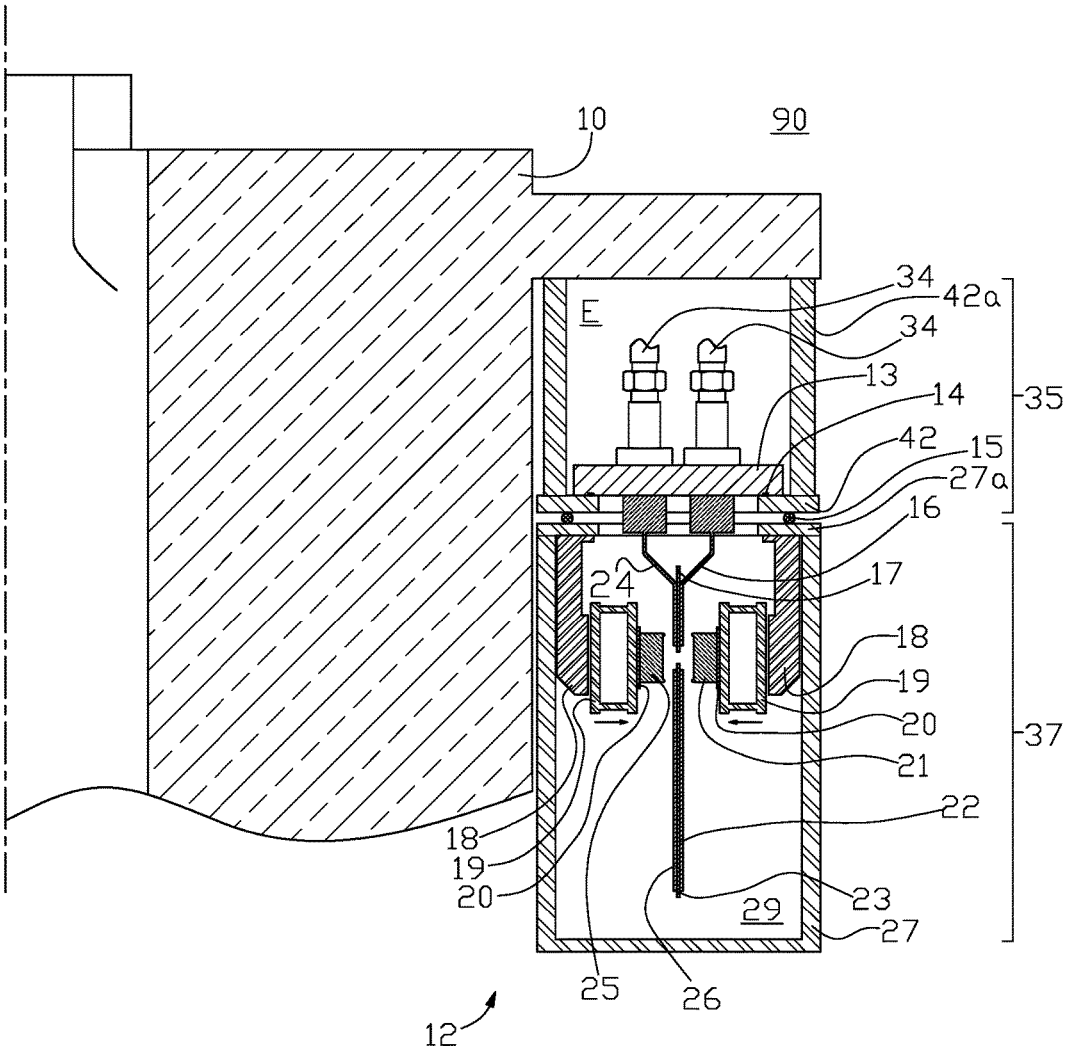
FIG. 2 is a detail cross-sectional view of one example of a dry-break electrical disconnect used with the induction melting assembly shown in FIG. 1(*a*) and FIG. 1(*b*) through line A-A in FIG. 1(*a*) showing the cradle's spade clamping assembly in the opened position.

FIG. 2 illustrates one example of the basic arrangement of componentry associated with the dry-break electrical disconnect of the present invention that can be used with an induction melting assembly, and in particular, with an induction melting assembly that operates in a vacuum or otherwise controlled environment. The dry-break electrical disconnect comprises a furnace spade assembly 35 (exteriorly attached to furnace 10) and a spade clamping and cradle spade assembly 37 (interiorly installed in cradle 12). In this example of the invention there are separate dry-break electrical disconnects located on either side of the furnace. In other examples of the invention a single dry-break electrical disconnect may be provided on one side of the furnace.

Figure 3:
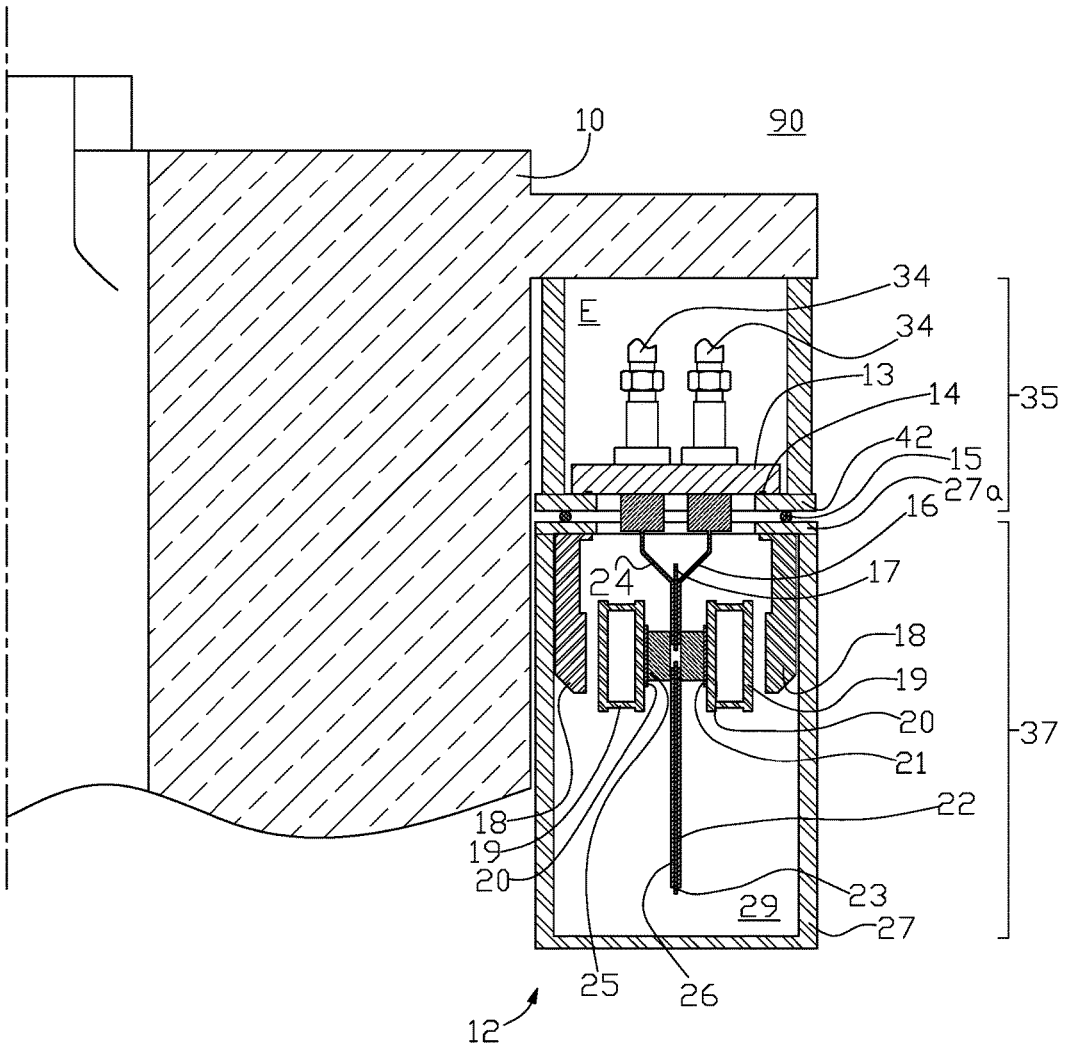
FIG. 3 is a detail cross-sectional view of one example of a dry-break electrical disconnect used with the induction melting assembly shown in FIG. 1(*a*) and FIG. 1(*b*) through line A-A in FIG. 1(*a*) showing the cradle's spade clamping assembly in the closed position.

Furnace spade assembly 35 comprises the following componentry in this example of the invention. Pressure plate 42 is suitably attached to furnace 10 (via offset posts 42*a* in this example). Positive and negative furnace electrical spades 16 and 24 are disposed within the pressure plate and protrude below the pressure plate as best seen in FIG. 2 and FIG. 3. The furnace electrical spades are suitably separated from each other, for example, by a furnace spade insulator plate 17 formed from an electrical insulating material and fed through a vacuum tight, insulated spade power port 13 sealed against the outer (vacuum) side of pressure plate 42 by suitable means such as one or more O-rings 14. External to the spade power port (including volume "E" in FIG. 2) is the operating vacuum environment 90 where the furnace electrical spades are connected to power leads 34 for the furnace induction coils. As shown in FIG. 1(*a*) and FIG. 1(*b*) power leads 34 can be a plurality of electrical cables running (connected) from the furnace electrical spades to the furnace's exterior wall penetrations 34*a* for connection to the furnace induction coil(s) surrounding the furnace crucible inside of the furnace's exterior wall. In some examples of the invention pressure plate 42 and spade power port 13 may be integrally formed as a single component.

A vacuum tight seal can be maintained by pressure plate 42 over an opening into internal volume 29 of cradle enclosure 27 to seal the cradle's interior volume that houses the spade clamping and cradle spade assemblies 37. The seal can be established, for example, by precision finishing of the facing surfaces of pressure plate 42 and the top 27*a* of cradle enclosure 27 with furnace 10 seated on the cradle to establish a close tolerance surfacing between the facing surfaces as required for a particular application. That is, the close tolerance surfacing achieves the required degree of sealing between the facing surfaces for a particular application. Alternatively the pressure plate can be spring-loaded fastened over the opening into internal volume 29 by a suitable spring-load clamping apparatus that is attached either to the furnace or cradle and clamps the pressure plate to the top of the cradle enclosure after the furnace is seated on the cradle. With either method one or more suitable sealing elements, such as gasket 15 may also be used to achieve the required level of sealing for a particular application. Further securing the furnace to the cradle, for example by fasteners, after seating of the furnace in the cradle may also be used to achieve the required level of sealing for a particular application.

Sealed interior volume 29 of cradle 12 is maintained at a nominal pressure that is greater than vacuum, or otherwise different from the controlled environment in which the induction furnace will be utilized in. Typically this interior volume will be an air composition at, or near, atmospheric pressure. The interior volume is pressurized since furnace 10 is installed (seated) on the cradle when the vacuum chamber (and the cradle's interior volume 29) is open to ambient air pressure prior to seating of pressure plate 42 over the opening into the cradle's internal volume 29; once the pressure plate is seated over the opening and sealed as described above, the vacuum chamber can be sealed and a vacuum can be established in the chamber for normal operation of the induction melting assembly while a pressurized environment is maintained with the cradle's interior volume. Alternatively if cradle power ports 36 are located external to the vacuum chamber as further described below, the sealed interior of the cradle may be open to atmosphere adjacent to the power ports that are external to the chamber's wall.

Located inside each interior volume of the tilting cradle is at least one spade clamping and cradle spade assemblies 37. A cradle spade assembly comprises the following componentry in this example of the invention. Positive and negative cradle electrical spades 22 and 26 are suitably separated from each other, for example, by cradle spade insulator plate 23 formed from an electrical insulating material.

The positive and negative cradle electrical spades 22 and 26 can be electrically connected within titling cradle 12 to an external power source via cradle power port 36 as further described below. Supply electric power can be provided to the cradle power ports 36 from one or more electric power sources. Cradle power port 36 can be located either internal or external (as further described below) to the vacuum chamber.

Each spade clamping assembly comprises the following componentry in this example of the invention: clamping guide supports 18; guided spade clamping frames 19, spade clamp electrical insulator plates 20, and positive and negative electrical spade clamps 21 and 25. Supports 18 function as structural clamping guides. Guided spade clamping frames are connected to a suitable actuator (not shown in the figures) to clamp the electrical spade clamps against their respective furnace and cradle electrical spades to supply the furnace coil(s) with electric power during furnace operation (power connect or closed position) and to unclamp the electrical spade clamps during furnace removal (power disconnect or opened position). The electrical spade clamps 21 and 25 are shown in the (unclamped) power disconnect position in FIG. 2, and would be actuated to apply pressure against their respective furnace and cradle electrical spades in the direction of the arrows in FIG. 2 and as shown in the power connect position in FIG. 3. Actuation of the electrical spade clamps may be powered by any suitable actuator apparatus to bring the spade clamps together as shown in the closed position (FIG. 3) and to separate the spade clamps as shown in the opened position (FIG. 2). The actuator apparatus can be remotely controlled from outside of the vacuum chamber to remotely open and close the electrical spade clamps.

The clamping guide supports, guided spade clamping frames, spade clamp electrical insulator plates, and electrical spade clamps 21 and 25 represent one means of selectively clamping the furnace and cradle electrical spades together within interior volume 29 of the cradle, and other means performing the same function within the interior volume are contemplated within the scope of the invention as long as they include a clamping electrical conductor for clamping against adjacent furnace and cradle electrical spades to close a circuit between the spaced apart furnace and cradle electrical spades when the interior volume of the cradle is sealed as described above.

Electrical spade clamps 21 and 25 may serve as the electrical conducting elements between the spaced apart furnace and cradle electrical spades, or may be configured with electrically conductive inserts that complete the electrical connections between the spaced apart lower ends of the furnace electrical spades 16 and 24, and the upper ends of the cradle electrical spades 22 and 26 as shown in FIG. 3.

FIG. 4 illustrates one example of the induction melting furnace tilting configuration in the present invention. The seated induction melting furnace 10 and tilting cradle 12 can be tilted by a total of four powered cylinders 55 that can be located outside of the vacuum chamber. Transition between inside and outside of the chamber is represented by stationary rotary vacuum seals 96 in FIG. 4 that could be fitted in the chamber's wall. The cylinders are located in pairs at either end of the tilting cradle trunnion 92 and adjacent to each cradle power port 36 with attachment to crank arm 98 (that is fitted around the trunnion) in a vertically opposed relationship. Each cylinder pair exerts an exact, opposite force on their respective crank arm in order to generate a "momentless" torque required for rotary motion of the tilting cradle and a furnace seated in the cradle. This arrangement is advantageous over arrangements with a single powered cylinder (and moment arm) at each end of the trunnion since high torque forces are avoided during the tilting process.

Figure 5B:
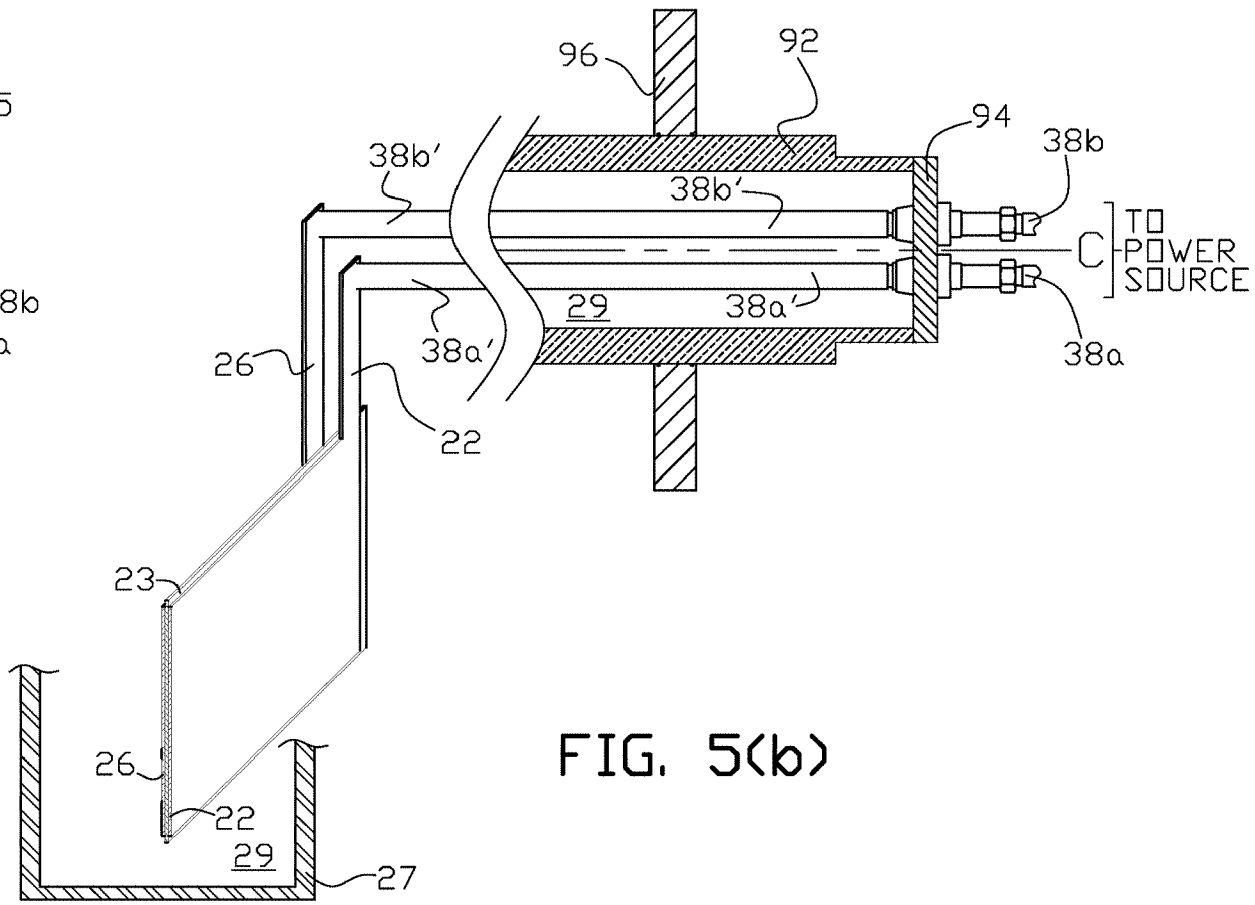
FIG. 5(*a*) is a partial perspective view of one example of a cradle trunnion used in the present invention.
Figure 5A:
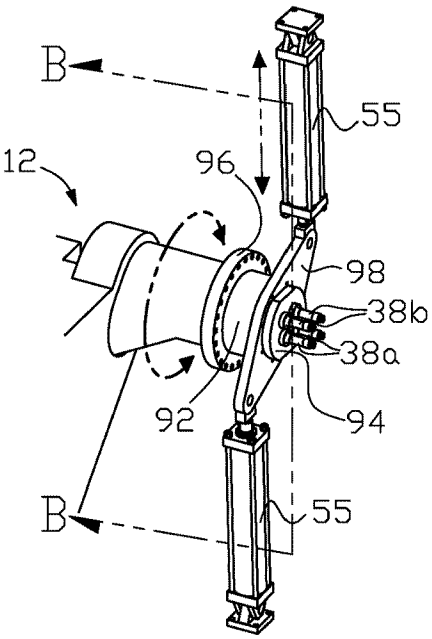

FIG. 5(*a*) and FIG. 5(*b*) illustrate one arrangement for supplying external electric power to the interior volume 29 of tilting cradle 12. External electric power conductors 38*a* and 38*b* can be flexible electric cables that are connected to one or more electric power sources supplying power to the one or more induction coils associated with induction melting furnace 10. The electric cables penetrate through environmental sealing plate 94 into interior volume 29 of the cradle. The sealing plate is a means for environmentally sealing the interior volume 29 of the cradle at the end of cradle trunnion 92. In this example the four electrical conductors are centered about the central rotational axis C of the cradle trunnion so that flexible external electrical conductors 38*a* and 38*b*, and cradle trunnion 92 rotate about the axis C. Within interior volume 29 of the rotatable cradle, electrical conductors 38*a*' and 38*b*' may be rigid or flexible electric conducting elements that are suitably connected electrically to the positive and negative cradle electrical spades 22 and 26 within interior volume 29 as diagrammatically illustrated in FIG. 5(*b*).

Figure 6B:
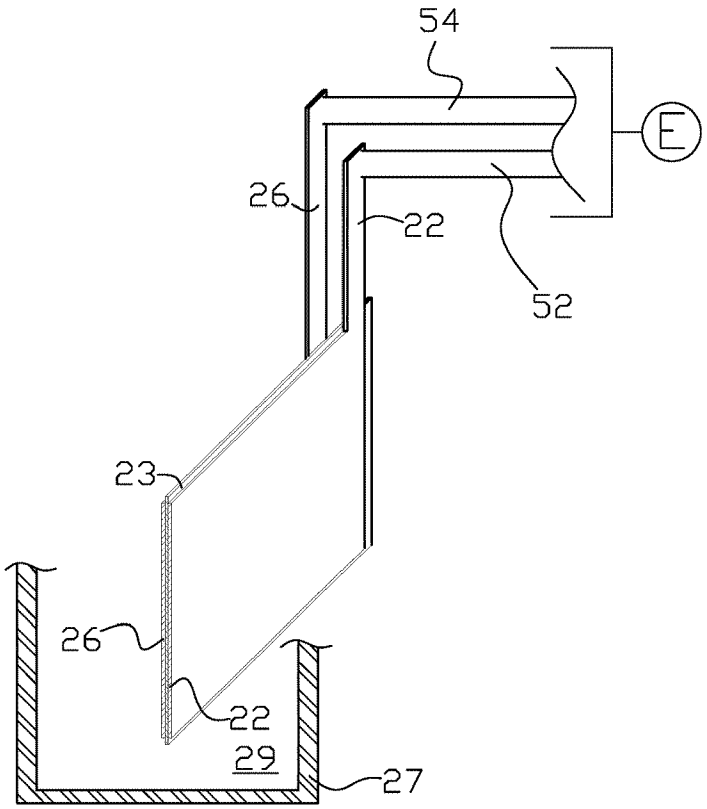
FIG. 6(*a*) is a partial perspective view of another example of a cradle trunnion used in the present invention.
Figure 6A:
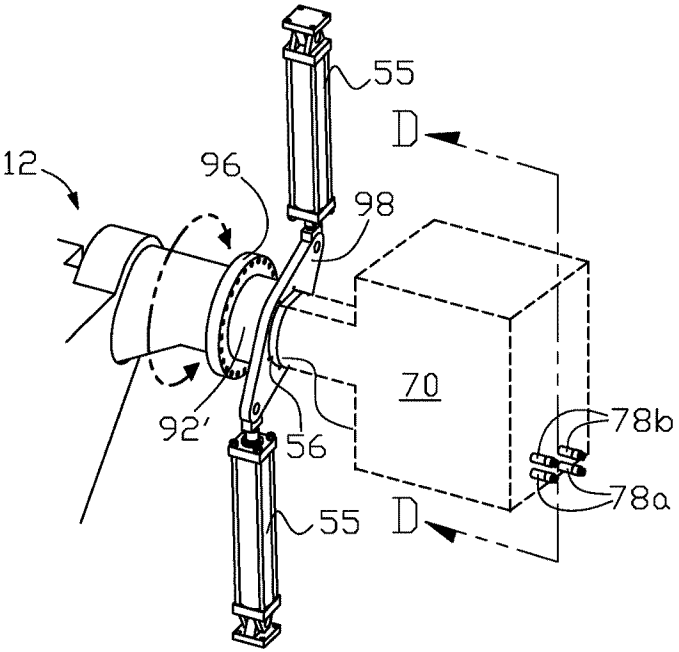
Figure 6C:
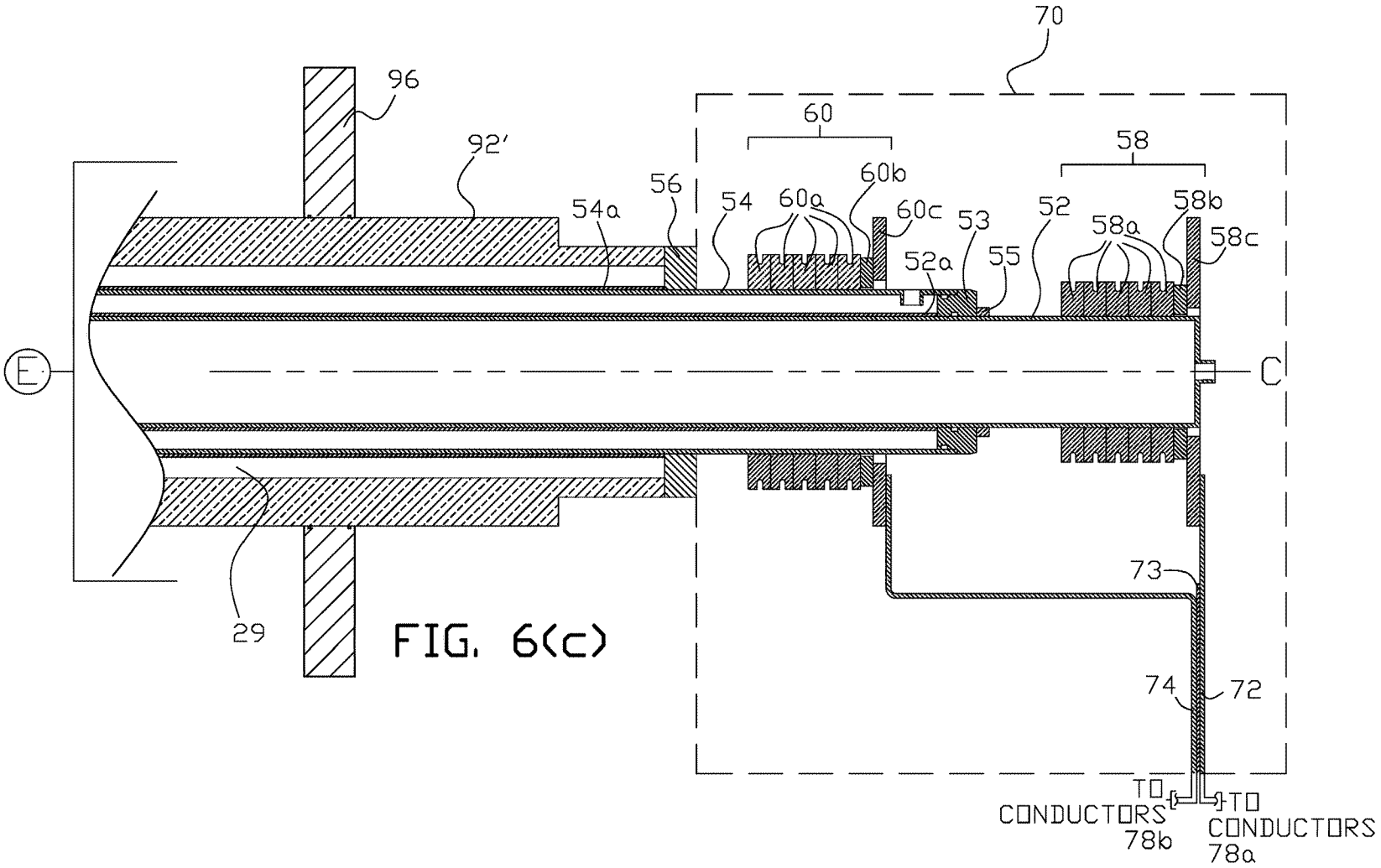

FIG. 6(*a*), FIG. 6(*b*) and FIG. 6(*c*) illustrate another arrangement for supplying external electric power to the interior volume 29 of tilting cradle 12. External electric power conductors 78*a* and 78*b* from one or more electric power sources supply power to the one or more induction coils associated with induction melting furnace 10 via coaxially arranged (positive and negative) inner and outer electrical coaxial (cylindrical) buses 52 and 54 as shown in FIG. 6(*c*). External power is supplied to the coaxial buses via sliding contact assemblies 58 and 60 that can be located external to the vacuum chamber in a volume designated by dotted lines 70 in FIG. 6(*a*) and FIG. 6(*c*). In this example of the invention electric power from electric conductors 78*a* and 78*b* are supplied to positive and negative electric power buses 72 and 74, which can be electrically isolated from each other by insulator 73 as shown in FIG. 6(*c*). The positive and negative electric power buses are respectively connected to stationary annular positive and negative electrical collector plates 58*c* and 60*c*. Power is respectively supplied from the positive and negative electrical collector plates to one or more stationary electrical sliding contacts 58*a* and 60*a* that can be spring loaded respectively against the outer surfaces of positive and negative electrical coaxial buses 52 and 54. The quantity of electrical sliding contacts associated with each coaxial bus (five shown in this example) will vary based upon ampacity requirements for a particular application. Anchor ring insulators 58*b* and 60*b* can be provided between the positive and negative electrical sliding contacts and their associated electrical collector plates as shown in the FIG. 6(*c*). The positive and negative electrical coaxial buses penetrate into a tunnel within interior volume 29 of cradle trunnion 92' via plate 56, which can provide both environmental sealing of the interior volume and support for the coaxial buses so that when the cradle trunnion is rotated by powered cylinders 55 the inner and outer electrical coaxial buses will also rotate. Sealing means are provided at the end of the outer electrical coaxial bus 54 that is located exterior to the cradle's interior volume 29 in this example to seal the volume between the inner surface of the outer electrical coaxial bus and the outer surface of the inner electrical coaxial bus 52. In this particular example, coaxial spacer insulation cap 53 and retaining ring 55 serve as the between coaxial bus volume sealing means. Electrical insulation 52*a* and 54*a* may be provided around the outer (or inner) surfaces of the inner or outer electrical coaxial buses as required for a particular application. Within interior volume 29 of the rotatable cradle, inner and outer electrical coaxial buses 52 and 54 are suitably connected electrically to the positive and negative cradle electrical spades 22 and 26 within interior volume 29 as diagrammatically illustrated in FIG. 6(*b*).

While the spade clamping and cradle spade assemblies 37 are located in a tilting cradle in the above examples of the invention, these assemblies may be installed in other components associated with the induction melting system within the vacuum or otherwise controlled environmental chamber in other examples of the invention. For example, if the furnace is a non-tilting furnace, the furnace may be seated in a fixed cradle within the chamber, and the spade clamping and cradle spade assemblies 37 may be installed within this fixed cradle.

While the above examples of the invention illustrate an electric induction melting assembly wherein a single phase alternating current source (with negative and positive instantaneous voltage and current designations) is supplied to the induction furnace, a multi-phase alternating current source is within the scope of the invention with additional componentry as described herein for additional phases of the multi-phase supply.

The term "electrical spade" is used herein to generally mean an electrically conductive plate material.

The present application is of particular use in vacuum induction melting quick change, low volume furnace applications.

The examples of the invention include reference to specific components. One skilled in the art may practice the invention by substituting components that are not necessarily of the same type but will create the desired conditions or accomplish the desired results of the invention. For example, single components may be substituted for multiple components or vice versa.

The invention claimed is:

1. A method of operation of an induction melting furnace removably installed in a cradle disposed in a controlled environment within a controlled environment chamber, the induction melting furnace having one or more furnace coil power leads from one or more furnace induction coils of the induction melting furnace to at least one positive furnace electrical spade comprises a plurality of said at least one positive furnace electrical spade, and at least one negative furnace electrical spade comprises a plurality of said at least one negative furnace electrical spade disposed in a furnace spade power port sealably attached to a pressure plate on the induction melting furnace with the at least one positive furnace electrical spade and the at least one negative furnace electrical spade penetrating through the pressure plate, the method comprising:

seating the induction melting furnace on the cradle prior to establishing the controlled environment within the controlled environment chamber so that the pressure plate forms a seal over a furnace electrical spades opening in an interior cradle volume of the cradle with the at least one positive furnace electrical spade and the at least one negative furnace electrical spade penetrating into a sealed interior cradle environment in the interior cradle volume, the interior cradle volume containing a cradle spade assembly and a spade clamping assembly;

forming the controlled environment within the controlled environment chamber subsequent to seating the induction melting furnace on the cradle to isolate the sealed interior cradle environment from the controlled environment; and moving at least one positive cradle clamping electrical spade comprises a plurality of said at least one positive cradle clamping electrical spade, and at least one negative cradle clamping electrical spade comprises a plurality of said at least one negative cradle clamping electrical spade from an opened position to a closed position within the sealed interior cradle environment to complete an electrical circuit between (1) said each of the at least one positive furnace electrical spades protruding through the pressure plate into the sealed interior cradle environment and said each of the at least one positive cradle clamping electrical spades associated with the cradle spade assembly, said each of the at least one positive cradle clamping electrical spades connected to a positive terminal of an external power source located external to the controlled environment and supplied to the sealed interior cradle environment, and (2) said each of the at least one negative furnace electrical spades protruding through the pressure plate into the sealed interior cradle environment and said each of the at least one negative cradle clamping electrical spades associated with the cradle spade assembly, said each of the at least one negative cradle clamping electrical spades connected to a negative terminal of the external power source, whereby electric power from the positive terminal and the negative terminal of the external power source is provided to the one or more furnace induction coils.

2. The method of claim 1 further comprising rotating the cradle subsequent to seating the induction melting furnace on the cradle by exerting opposing forces on a crank arm fitted to each opposing end of a trunnion provided on the cradle to rotate the induction melting furnace and the cradle about a central axis of the trunnion.

3. The method of claim 1 further comprising clamping the pressure plate over a top of the furnace electrical spades opening prior to establishing the controlled environment within the controlled environment chamber and after seating the induction melting furnace on the cradle.

4. The method of claim 1 further comprising moving the at least one positive cradle clamping electrical spade and the at least one negative cradle clamping electrical spade from the closed position to the opened position to open the electrical circuit between (1) said each of the at least one positive furnace electrical spades protruding through the pressure plate into the sealed interior cradle environment, and said each of the at least one positive cradle clamping electrical spades and (2) said each of the at least one negative furnace electrical spades protruding through the pressure plate into the sealed interior cradle environment, and said each of the at least one negative cradle clamping electrical spades, whereby the electric power from the positive terminal and the negative terminal of the external power source is interrupted from the one or more furnace induction coils.

5. The method of claim 4 further comprising releasing the controlled environment within the controlled environment chamber with the induction melting furnace seated on the cradle with the at least one positive cradle clamping electrical spade and the at least one negative cradle clamping electrical spade in the opened position and removing the induction melting furnace from the cradle.

6. A method of operation of an induction melting furnace removably installed in a cradle disposed in a controlled environment within a controlled environment chamber, the induction melting furnace having one or more furnace coil water connections and one or more furnace coil power leads, the one or more furnace coil water connections separated from the one or more furnace coil power leads, the one or more furnace coil power leads connected from one or more furnace induction coils of the induction melting furnace to at least one positive furnace electrical spade comprises a plurality of said at least one positive furnace electrical spade, and at least one negative furnace electrical spade comprises a plurality of said at least one negative furnace electrical spade disposed in a furnace spade power port sealably attached to a pressure plate on the induction melting furnace with the at least one positive furnace electrical spade and the at least one negative furnace electrical spade penetrating through the pressure plate, the at least one positive furnace electrical spade, the at least one negative furnace electrical spade and the pressure plate forming a furnace spaced assembly located on at least one side of the induction melting furnace, the method comprising:

seating the induction melting furnace on the cradle prior to establishing the controlled environment within the controlled environment chamber so that the pressure plate forms a seal over a furnace electrical spades opening in an interior cradle volume of the cradle with the at least one positive furnace electrical spade and the at least one negative furnace electrical spade penetrating into a sealed interior cradle environment in the interior cradle volume, the interior cradle volume containing a cradle spade assembly and a spade clamping assembly;

forming the controlled environment within the controlled environment chamber subsequent to seating the induction melting furnace on the cradle to isolate the sealed interior cradle environment from the controlled environment; and moving at least one positive cradle clamping electrical spade comprises a plurality of said at least one positive cradle clamping electrical spade, and at least one negative cradle clamping electrical spade comprises a plurality of said at least one negative cradle clamping electrical spade from an opened position to a closed position within the sealed interior cradle environment to complete an electrical circuit between said each of the at least one positive furnace electrical spades protruding through the pressure plate into the sealed interior cradle environment and said each of the at least one positive cradle clamping electrical spades associated with the cradle spade assembly, and said each of the at least one negative furnace electrical spades protruding through the pressure plate into the sealed interior cradle environment and said each of the at least one negative cradle clamping electrical spades associated with the cradle spade assembly.

7. The method of claim 6 further comprising connecting said each of the at least one positive cradle clamping electrical spades to a positive terminal of an external power source and connecting said each of the at least one negative cradle clamping electrical spades to a negative terminal of the external power source to supply electric power to the one or more furnace induction coils.

8. The method of claim 6 wherein a gasket is interposed between facing opposing sides of the pressure plate and a top of the furnace electrical spades opening to form the seal.

9. The method of claim 8 further comprising clamping the pressure plate over the top of the furnace electrical spades opening prior to establishing the controlled environment within the controlled environment chamber and after seating the induction melting furnace on the cradle.

10. The method of claim 6 further comprising spring-load clamping the pressure plate over the furnace electrical spades opening after seating the induction melting furnace on the cradle.

11. The method of claim 6 further comprising rotating the cradle subsequent to seating the induction melting furnace on the cradle by exerting opposing forces on a separate crank arm fitted at each opposing end of a trunnion provided on the cradle to rotate the induction melting furnace and the cradle about a central axis of the trunnion by a separate pair of powered cylinders located at said each opposing end of the trunnion to exert an exact opposite force on the crank arms fitted at said each opposing end of the trunnion to generate a momentless torque for rotating the cradle.

12. The method of claim 7 further comprising supplying the electric power from the external power source with coaxially arranged electrical buses disposed within a trunnion provided on the cradle.

13. The method of claim 6 further comprising moving the at least one positive cradle clamping electrical spade and the at least one negative cradle clamping electrical spade from the closed position to the opened position to open the electrical circuit between (1) said each of the at least one positive furnace electrical spades protruding through the pressure plate into the sealed interior cradle environment, and said each of the at least one positive cradle clamping electrical spades, and (2) said each of the at least one negative furnace electrical spades protruding through the pressure plate into the sealed interior cradle environment, and said each of the at least one negative cradle clamping electrical spades.

14. The method of claim 13 further comprising releasing the controlled environment within the controlled environment chamber with the induction melting furnace seated on the cradle with the at least one positive cradle clamping electrical spade and the at least one negative cradle clamping electrical spade in the opened position.

15. A method of operation of an induction melting furnace removably installed in a cradle disposed in a controlled environment within a controlled environment chamber, the induction melting furnace having one or more furnace coil power leads from one or more furnace induction coils of the induction melting furnace to at least one positive furnace electrical spade comprises a plurality of said at least one positive furnace electrical spade, and at least one negative furnace electrical spade comprises a plurality of said at least one negative furnace electrical spade disposed in a furnace spade power port sealably attached to a pressure plate on the induction melting furnace with the at least one positive furnace electrical spade and the at least one negative furnace electrical spade penetrating through the pressure plate, the method comprising:

seating the induction melting furnace on the cradle prior to establishing the controlled environment within the controlled environment chamber and sealing the pressure plate over a furnace electrical spades opening in an interior cradle volume of the cradle by clamping the pressure plate over a top of the furnace electrical spades opening with the at least one positive furnace electrical spade and the at least one negative furnace electrical spade penetrating into a sealed interior cradle environment in the interior cradle volume, the interior cradle volume containing a cradle spade assembly and a spade clamping assembly;

forming the controlled environment within the controlled environment chamber subsequent to seating the induction melting furnace on the cradle to isolate the sealed interior cradle environment from the controlled environment; and moving at least one positive cradle clamping electrical spade comprises a plurality of said at least one positive cradle clamping electrical spade, and at least one negative cradle clamping electrical spade comprises a plurality of said at least one negative cradle clamping electrical spade from an opened position to a closed position within the sealed interior cradle environment to complete an electrical circuit between (1) said each of the at least one positive furnace electrical spades protruding through the pressure plate into the sealed interior cradle environment and said each of the at least one positive cradle clamping electrical spades associated with the cradle spade assembly, said each of the at least one positive cradle clamping electrical spades connected to a positive terminal of an external power source located external to the controlled environment and supplied to the sealed interior cradle environment, and (2) said each of the at least one negative furnace electrical spades protruding through the pressure plate into the sealed interior cradle environment and said each of the at least one negative cradle clamping electrical spades associated with the cradle spade assembly, said each of the at least one negative cradle clamping electrical spades connected to a negative terminal of the external power source, whereby electric power from the positive terminal and the negative terminal of the external power source is provided to the one or more furnace induction coils.

16. The method of claim 15 further comprising moving the at least one positive cradle clamping electrical spade and the at least one negative cradle clamping electrical spade from the closed position to the opened position to open the electrical circuit between (1) said each of the at least one positive furnace electrical spades protruding through the pressure plate into the sealed interior cradle environment, and said each of the at least one positive cradle clamping electrical spades and (2) said each of the at least one negative furnace electrical spades protruding through the pressure plate into the sealed interior cradle environment, and said each of the at least one negative cradle clamping electrical spades, whereby the electric power from the positive terminal and the negative terminal of the external power source is interrupted from the one or more furnace induction coils.

17. The method of claim 15 further comprising rotating the cradle subsequent to seating the induction melting furnace on the cradle by exerting opposing forces on a separate crank arm fitted at said each opposing end of a trunnion provided on the cradle to rotate the induction melting furnace and the cradle about a central axis of the trunnion by a separate pair of powered cylinders located at said each opposing end of the trunnion to exert an exact opposite force on the crank arms fitted at each opposing end of the trunnion to generate a momentless torque for rotating the cradle.

18. The method of claim 16 further comprising releasing the controlled environment within the controlled environment chamber with the induction melting furnace seated on the cradle with the at least one positive cradle clamping electrical spade and the at least one negative cradle clamping electrical spade in the opened position and removing the induction melting furnace from the cradle.

* * * * *